United States Patent [19]

Wrulich et al.

[11] 4,091,692

[45] May 30, 1978

[54] BIT HOLDER

[75] Inventors: Herwig Wrulich; Otto Schetina, both of Zeltweg, Austria

[73] Assignee: Vereinigte Osterreichische Eisen- und Stahlwerke-Alpine Montan Aktiengesellschaft, Vienna, Austria

[21] Appl. No.: 733,407

[22] Filed: Oct. 18, 1976

[30] Foreign Application Priority Data

Oct. 29, 1975 Austria ..... 8241/75

[51] Int. Cl.[2] ..... B21K 21/00; E21C 13/00

[52] U.S. Cl. ..... 76/101 R; 299/91

[58] Field of Search ..... 175/409, 410, 411; 299/89, 91, 10; 76/101 A, 101 R

[56] References Cited

U.S. PATENT DOCUMENTS

| | | | |
|---|---|---|---|
| 3,356,418 | 12/1967 | Healey et al. | 175/411 |
| 3,533,311 | 10/1970 | Allds et al. | 76/101 R |
| 3,544,166 | 12/1970 | Proctor | 299/91 |
| 3,614,164 | 10/1971 | Davis | 299/89 |
| 3,913,979 | 10/1975 | Strauss et al. | 299/91 |
| 3,958,832 | 5/1976 | Sigott et al. | 299/89 |

*Primary Examiner*—Harrison L. Hinson

*Attorney, Agent, or Firm*—Cushman, Darby & Cushman

[57] ABSTRACT

A bit holder consisting of steel, said bit holder comprising a bore for accommodating the bit shaft and being welded to the cutting head of a cutting machine, characterized in that the bit holder consists of a part of heat-resistant steel of high strength and of a foot consisting of an unalloyed or low alloy steel of good weldability and being welded to said foot over the whole contacting area. In making the holder a blank corresponding to the part accommodating the bit shaft is over the whole contacting area welded to a blank corresponding to the foot to provide a composite blank which is subsequently forged in a forging die.

4 Claims, 2 Drawing Figures

BIT HOLDER

Figure 1:
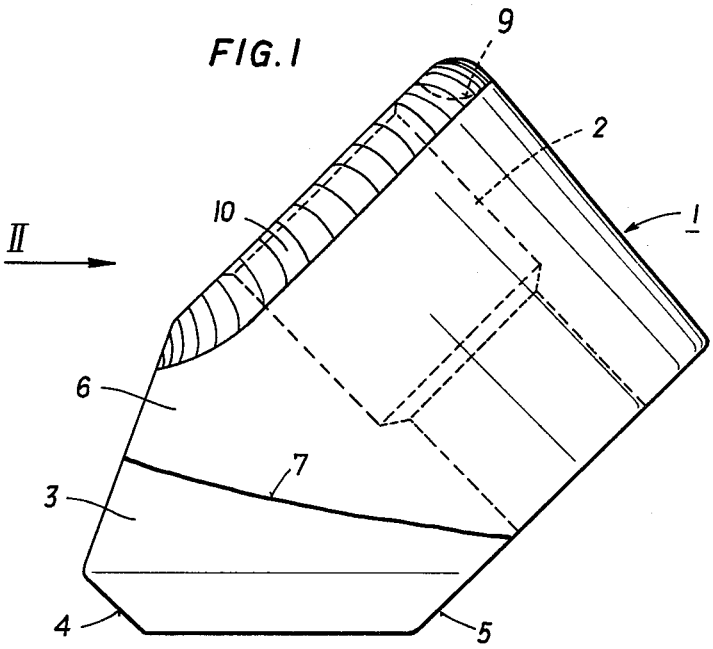

Cutting heads of cutting machines have the bits inserted into bores of bit holders being welded to the base member of the cutting head. Such bit holders are subjected to high loads and must consist of high-quality steel in view of being in contact with the rock to be cut which is only irregularly fractured. Therefore, such bit holders consist, as a rule, of a heat-resistant steel of high strength, whereas the base member of the cutting head consists, as a rule, of a well weldable constructional steel. Welding of such bit holders to the base member of the cutting head is, however, extremely difficult because such steels require pre-heating of the constructional parts to be welded with one another. The base member of the cutting head is a bulky, heavy constructional part because the cutting heads have a relatively great diameter, so that pre-heating of this base member is extremely difficult and includes the danger of distorting the base member.

The invention now refers to such a bit holder consisting of steel, said bit holder comprising a bore for accommodating the bit shaft and being welded to the cutting head of a cutting machine and aims at avoiding the drawbacks of known embodiments of such bit holders. The invention essentially consists in that the bit holder consists of a part of heat-resistant steel of high strength and of a foot consisting of an unalloyed or low alloy steel of good weldability and being welded to said foot over the whole contacting area. The foot, consisting of well weldable steel, of the bit holder is being welded to the base member of the cutting head, noting that pre-heating of this base member of the cutting head is not necessary. While in constructions up till now severe quality standards had been applied to the weld, the welding operation is now substantially simplified. In view of pre-heating the base member of the cutting head being not required any danger of distortion is avoided.

The inventive process for producing such a bit holder essentially consists in that a blank corresponding to the part accommodating the bit shaft is over the whole contacting area welded to a blank corresponding to the foot to provide a composite blank which is subsequently forged in a forging die. Welding of the mentioned parts over their whole contacting areas is, according to the invention, conveniently effected by flash butt welding or friction welding or forge welding, respectively. When welding said both blanks together, those difficulties are not encountered which are encountered when welding a part consisting of a heat-resistant steel of high strength to the bulky base member, consisting of a weldable constructional steel, of the cutting head. The parts to be welded are relatively small parts which can be pre-heated without any problem and which must at any rate be welded together in a heated condition. Distortion of the welded parts does not represent any danger because the welded blanks are subsequently forged to the desired shape in the forging die. Manufacturing of the bit holder of two materials only immaterially exceeds the cost of manufacturing a bit holder of one single material, however, reduction of the expenditure required for welding the bit holder to the base member of the cutting head is quite substantial.

The invention is further illustrated with reference to the drawing showing an embodiment of the invention.

Figure 2:
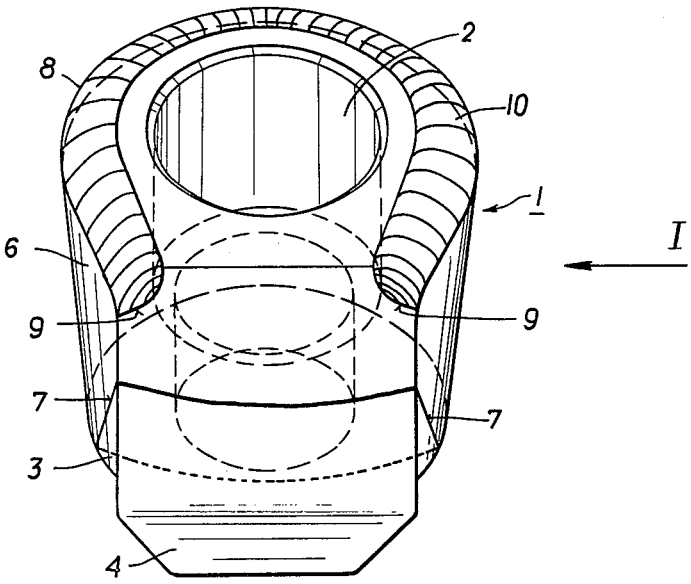

FIG. 1 represents at bit holder in a lateral view as seen in direction of arrow I of FIG. 2 and, FIG. 2 represents the bit holder in a view as seen in direction of arrow II of FIG. 1.

The bit holder 1 has a bore 2 for accommodating the bit and further has a foot 3 by means of which the bit holder is welded to the base member of the cutting head. The chamfers 4 and 5 provide the space needed for applying the weld bead connecting the bit holder to the base member of the cutting head. The part 6 being provided with the bore 2 for the bit holder consists of a heat-resistant steel of high strength. The foot 3 consists of an unalloyed or low alloy steel of good weldability. The separating line between the part 6 consisting of heat-resistant steel of high strength and the part 3 of well weldable steel is indicated with the reference numeral 7. The parts 6 and 3 are welded one to another over the whole contacting area.

The rim 8 of the bit holder is surrounding the bore 2 and subjected to the highest wear in view of being the area most frequently in contact with the rock. According to the embodiment shown in the drawing in this rim 8 a groove 9 is provided which is filled with a welding bead 10. Welding at this area does not result in any difficulties because the bit holder is a relatively small part which can be pre-heated without any problems.

We claim:

1. A process for producing a bit holder of the type having a foot portion and a bore for accommodating a bit shaft and which is to be welded to the cutting head of a cutting machine, said process comprising the steps of:

welding a high strength, heat resistant steel blank corresponding to the part accommodating the bit shaft over an entire contacting area to a steel blank corresponding to said foot portion to provide a composite blank and then subsequently forging said composite blank in a forging die to a desired shape.

2. The process as claimed in claim 1 wherein said welding is effected by flash butt welding.

3. The process as claimed in claim 1 wherein said welding is effected by friction welding.

4. The process as claimed in claim 1 wherein said welding is effected by forge welding.

* * * * *